US006231247B1

(12) United States Patent
Wrye et al.

(10) Patent No.: US 6,231,247 B1
(45) Date of Patent: May 15, 2001

(54) RECIRCULATING-X-RAY FILM PROCESSING APPARATUS

(75) Inventors: Kenneth S. Wrye; David W. Crowe, both of Palos Verdes Estates, CA (US)

(73) Assignee: Dow Imaging, Inc., Paramount, CA (US)

( * ) Notice: Subject to any disclaimer, the term of this patent is extended or adjusted under 35 U.S.C. 154(b) by 0 days.

(21) Appl. No.: 09/561,605

(22) Filed: Apr. 27, 2000

(51) Int. Cl.[7] ..... G03D 3/02
(52) U.S. Cl. ..... 396/626; 134/64 P; 137/563
(58) Field of Search ..... 396/626; 355/27–29; 134/122 R, 122 P, 64 R, 64 P; 137/563, 577

(56) References Cited

U.S. PATENT DOCUMENTS

| | | | | |
|---|---|---|---|---|
| 2,920,469 | | 1/1960 | Henshaw, Jr. | 137/113 |
| 3,319,651 | | 5/1967 | Ullman, Jr. et al. | 137/563 |
| 3,332,435 | | 7/1967 | Anderson et al. | 137/563 |
| 3,387,626 | | 6/1968 | Morris et al. | 137/563 |
| 3,480,025 | | 11/1969 | Hsu et al. | 137/563 |
| 3,851,662 | | 12/1974 | Jessop | 396/626 |
| 4,349,267 | | 9/1982 | Ohtani | 396/625 |
| 4,922,943 | | 5/1990 | Gill | 137/563 |
| 5,203,367 | | 4/1993 | Akai | 203/96 |
| 5,446,516 | * | 8/1995 | Burbury et al. | 396/626 |
| 5,829,467 | | 11/1998 | Spicher | 137/14 |

* cited by examiner

*Primary Examiner*—D. Rutledge
(74) *Attorney, Agent, or Firm*—Fulwider Patton Lee & Utecht, LLP

(57) ABSTRACT

A recirculating system including a fluid supply tank with a plurality of flow sites for directing flow in and out of the tank along with a pump for driving the fluid flow and a set of fluid connectors providing fluid communication between such tank and a medical image processor which is particularly useful for sustaining prolonged operation of such processor during times of inadequate water supply.

19 Claims, 1 Drawing Sheet

RECIRCULATING-X-RAY FILM PROCESSING APPARATUS

BACKGROUND OF THE INVENTION

1. Field of the Invention

The invention relates generally to X-ray processing and more specifically to a dedicated water supply for supplying fluid to an X-ray processor.

2. Description of the Prior Art

Current practice in the medical and dental industries is to rely on X-ray processors for developing images. The typical X-ray processor includes a frame or cabinet for holding a variety of equipment such as several small containers for holding a supply of developer and fixer, heat exchangers, pumps, temperature sensors and wiring harnesses for electrical connection to an outlet. The processor unit is also typically hooked up by a hose to a water supply such as a water main to receive a supply of cold wash water. Generally, the film to be developed is first held under the developer, then the fixer, and then cold wash water to rinse the chemicals from the film prior to drying the film for final viewing.

Conventional models of film processors have water usage rates at 1.5 gallons per minute. Conservative estimates reveal that a single processor unit may use 187,200 gallons of water per year and typically much more. This is a tremendous burden on water conservation efforts. The enormous amount of water being used is a particularly acute problem during natural disasters such as periods of drought, earthquake, thunderstorms, freezing conditions, and in remote locations where water is scarce or the source of water has been temporarily removed.

One recirculation approach is found in U.S. Pat. No. 3,480,025 to Hsu et al. which discloses a flow recirculation system for use with trickle filters or cooling towers. A reservoir is used in conjunction with a plumbing system which includes an external pump and a T-shaped flow divider which either directs flow into a drain or returns the fluid back into the tank depending on the water level. The water level is generally maintained because the flow divider is in fluid communication with the fluid in the tank and, if the fluid level should rise too high, fluid is diverted into the drain line. This device uses back pressure in the return line to keep the fluid at a fairly constant level by dumping excess fluid into the drainage opening. As the drain line and return lines are branches of the same pipe, a flow obstruction in one the lines may interfere with the flow in the other.

Another type of circulation device is described in U.S. Pat. No. 3,851,662 to Jessop. This circulating apparatus includes side-by-side utilization and circulation containers separated by a weir plate. A supply container mounted higher than the side-by-side containers provides processing solution for introduction into the other containers. A conduit system connects a transfer pump used to initially transfer processing solution from the supply container to the circulation container. As fluid fills up in the utilization container it will spill over the weir plate into the circulation container until hydrostatic equilibrium is reached indicating that a complete changeover has occurred and the pump then draws solely from the circulation container instead of the supply container. This does not result in a continuous circulation loop between the original fluid supply and the processing tank as one container is eventually substituted for another upon reaching hydrostatic equilibrium.

Yet another device is shown in U.S. Pat. No. 4,349,267 to Ohtani. This device incorporates a first circulation pipe systems for circulating processing solution and a second circulation pipe system for another developing fluid. A pair of pumps is used to circulate the selected processing fluid through a processing tray and a pair of magnetic switches directs the flow through the system. Wash water is independently supplied to a shower pipe through a feed pipe line. After using the wash water to wash the processing tray, the waste water is discharged out the drain not to be used again.

What is needed and heretofore unavailable is a recirculation unit that is easy to assemble to a preexisting film processor requiring wash water for developing images, takes up limited space, is low maintenance, significantly reduces the amount of water required, without significantly degrading the quality of film images over time.

SUMMARY OF THE INVENTION

In accordance with a preferred embodiment of the present invention, an easy to assemble recirculation system is provided for use with a medical imaging processor for prolonged periods of operation during times of inadequate water supply to markedly improve the conservation of the fluid. The recirculation system generally incorporates a supply tank for holding a processing fluid and further includes an outlet connector and drainage connector coupled between outlet and return ports of the supply tank and inlet and drainage ports of the medical imaging processor. A pump having a submersible intake is driven by a motor to draw fluid from the tank and into the outlet connector toward the processor. Return fluid is circulated from the processor back into the tank for subsequent drawing up by the pump and back into the resupply line. Continuous operation provided by an initially full tank may last up to a week.

Other features of the present invention include a plurality of flow sites enabling a variety of means to introduce fluid into the tank such as a metering control box for measured amounts of fluid.

Other features and advantages of the present invention will become more apparent from the following detailed description of the invention, when taken in conjunction with the accompanying exemplary drawings.

DETAILED DESCRIPTION OF THE PREFERRED EMBODIMENT

Figure 1:
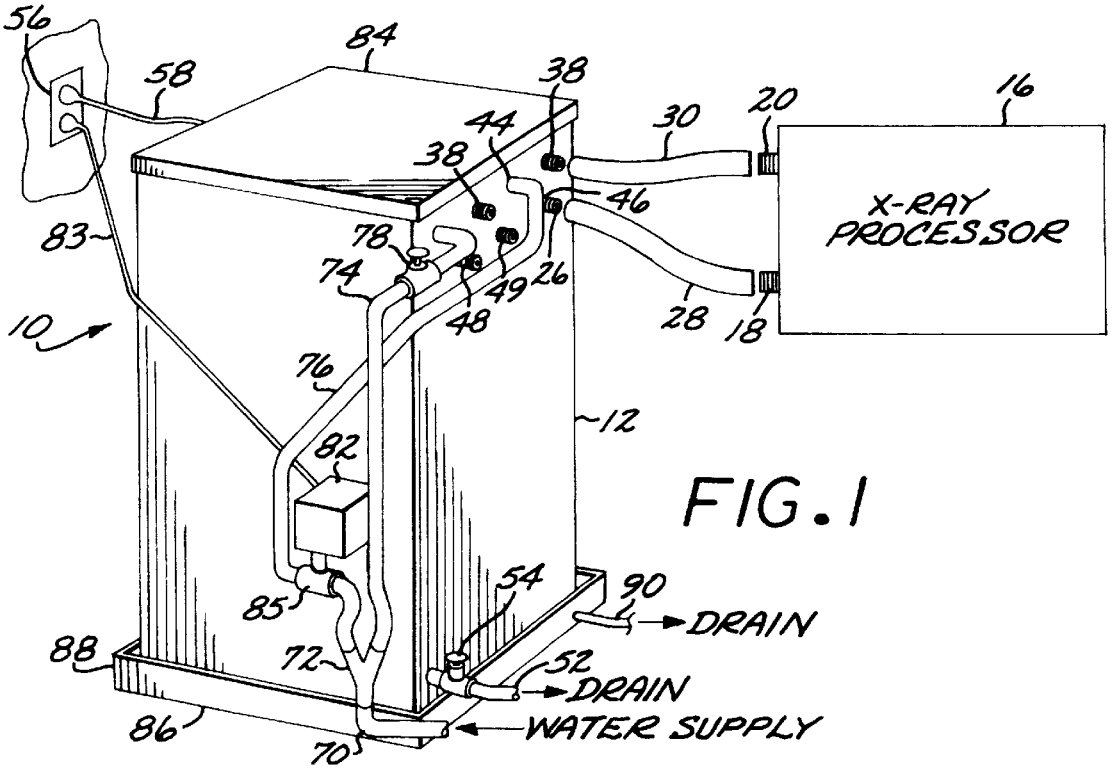
FIG. 1 is a perspective view of a recirculating X-ray film processor apparatus embodying the present invention.
Figure 2:
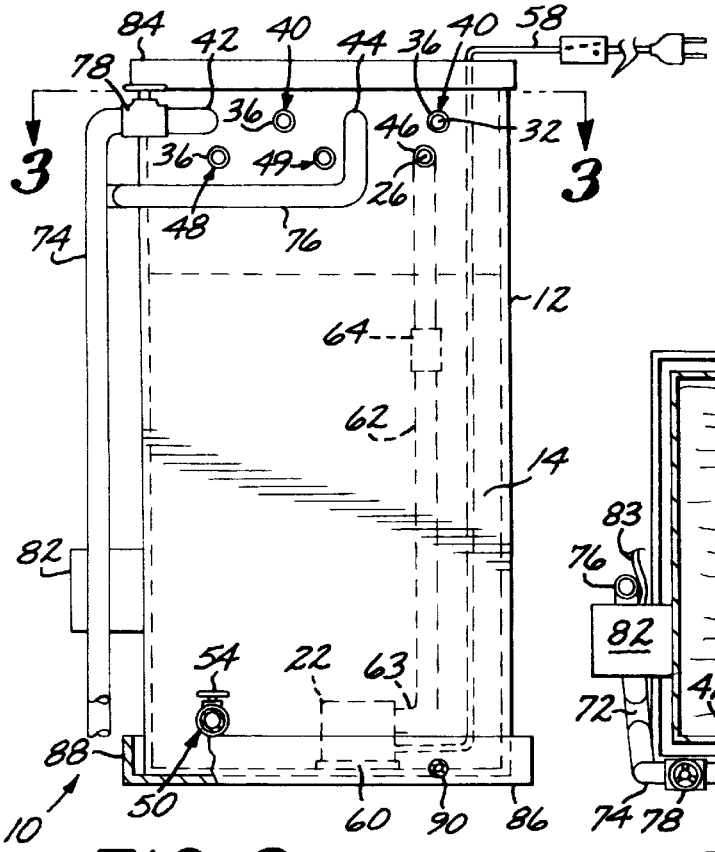
FIG. 2 is a rigthside view, in enlarged scale, of the recirculating X-ray film processor apparatus shown in FIG. 1.
Figure 3:
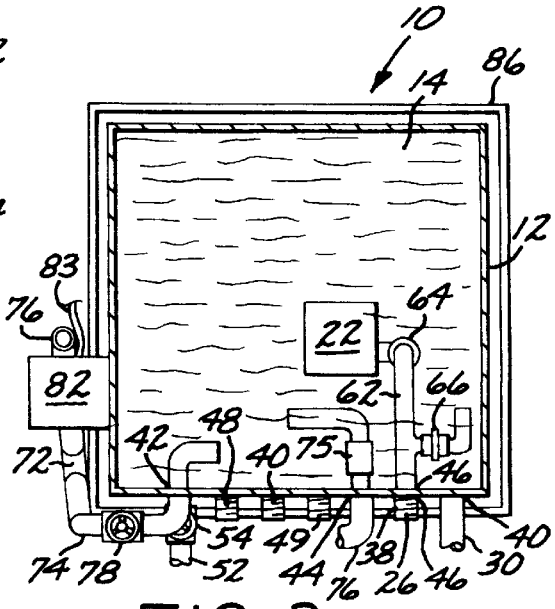
FIG. 3 is a sectional view taken along the lines 3—3 of FIG. 2.

Referring now to FIGS. 1–3, a recirculation apparatus, generally designated 10, is provided for supplying a prolonged supply of fluid such as water to a film processor used in the medical imaging industry, particularly an X-ray film processor, thereby reducing the amount of water normally expended during film development. The advantages of this system become even more apparent in times of limited water availability such as emergency situations where the main water supply is shut off. Continued operation of equipment such as medical X-ray processors during natural disasters is critical to providing proper medical care. With a limited supply of water and source of power such as a generator, the water recirculation system described herein may provide a supply of water to an X-ray processor for about a week on one tank and for a longer time period if prolonged storage of the X-ray film is not a concern.

In accordance with an embodiment of the present invention, the water recirculation apparatus 10 includes generally a tank 12 for storing a supply of fluid 14 such as water to be utilized by a film processor 16 having an inlet port 18 and a drainage port 20, and a pump with a motor 22 for drawing water from the tank and forcing it toward the processor through a processor supply outlet 26. An outlet connector 28 is provided for connecting the outlet 26 with the inlet port 18 of the processor and providing one portion of the recirculation loop. A drainage connector 30 provides a second conduit for returning fluid from the processor drainage port 20 back to a return orifice 32 in the tank thereby completing the recirculation loop.

The tank 12 is generally about 12 inches square in horizontal cross section and 24 to 25 inches high. The top edge of the tank defines an opening into which fluid may be poured. The overall dimensions allow for about a 15 gallon capacity. It has been determined that 12–15 gallons provides a sufficient supply of fluid for running an X-ray processor for about a week without the introduction of additional water and without significant degradation of film quality over time. A suggested water fill line (not shown) on the inside or outside of the tank may be included and typically ranges between a 12 and 15 gallon capacity or other suitable increments. It will be appreciated that alternative tank shapes and sizes can be used with detracting from the scope of the present invention.

The tank 12 is preferably manufactured of a high density polyethylene material and includes a number of flow sites where fluid is directed either into the tank or away from the tank. Each flow site includes a one-half inch diameter threaded port 36 which includes a circular one-half inch diameter hose nipple 38 having one portion threadedly received into the respective port. One end of each nipple forms a mounting sleeve for a fluid connector between the tank and the processor or between the tank and an incoming water source such as a water main. Such nipples may also project into the tank to provide an internal mounting sleeve for any internal hoses. Each hose nipple is hollow allowing fluid communication between the inside and the outside of the tank. The mounting nipples forming the hose connectors are generally constructed in a similar manner and may include an outer diameter that is either threaded, unthreaded, or ribbed to accommodate different types of conventional hose connections. Quick release hose couplings may also be used. While the accompanying drawings illustrate one manner of placing the sites around the tank, it will be appreciated that other suitable arrangements as to the size and location of the sites on the tank may be incorporated without detracting from the spirit and scope of the invention.

In the illustrated embodiment, there are eight such independent flow sites having connector nipples: two flow return sites 40, a primary fill site 42, and a secondary fill site 44 spaced equidistantly near the top edge of the tank form an upper flow tier. The primary and secondary fill sites are for introduction of water into the tank from a water main or other primary water source. Through at least one of the two flow return nipples 40, which incorporates return orifice or port 32, fluid returning from an X-ray processor or processor is introduced back into the tank. If multiple processors are used, they may be connected to other return flow sites. The flow return sites are positioned above the water line established at full capacity to reduce chances of backflow toward the processor.

Referring to FIG. 1, a processor supply nipple 46 and two emergency overflow nipples 48 and 49 form a second tier beneath the upper tier. The processor supply nipple 46 forms a hose connector 38 that also projects inwardly from the inside tank wall. The emergency overflow ports are located to limit the water level to avoid interfering with flow through the return sites or flowing out the top of the tank. A cleanout site 50 comprises the eighth flow site located near the bottom of the tank. A small section of hose 52 or pipe connects to the cleanout site hose connector and includes a drain valve 54 allowing an operator to release fluid from the tank as desired. Alternatively, a plug may be used.

On the floor of the tank 12 is placed a submersible, fluid displacement pump 22. The pump may be secured within the tank or merely rest on the bottom. A motor is incorporated to drive the pump. Electrical power to a 115 Volt, 60 Hertz motor in the pump is generally supplied by a cannon electrical outlet 56. An electrical cord 58 connects the pump motor to the outlet. The cord should be of a variety constructed for partial submersion under water to safely facilitate placement of the pump in the water. Alternatively, the pump could be powered by a generator sufficient to supply the correct power. A power rating of 1/50 horsepower has been found to provide satisfactory circulation throughout the system. This rating could be increased or decreased depending on situations such as incorporating an additional processor or a smaller tank.

Referring to FIG. 3, the pump 22 includes a downwardly facing intake 60 submerged in the fluid for drawing water 14 into the pump. The intake is supported slightly off the bottom of the tank to maximize the fluid drawing capacity of the pump. The face of the intake typically includes a screen for preventing any potentially damaging foreign objects from entering the pump. Forming a fluid path for transporting water from the pump and out of the tank 12 through the processor supply outlet 26 is a processor supply tube 62. One end of the processor supply tube telescopically mounts over a conventional tube stub 63 on the pump. The opposite end of the processor supply tube mounts to one side of a T-shaped inwardly projecting hose nipple 38 located at the processor supply site 46 thereby forming one leg of the recirculation loop. Mounted within the supply tubing is a check valve 64 for preventing backflow into the pump. The opposing branch of the T-shaped hose nipple is connected via ½ inch clear vinyl tubing to a ½ inch flow control valve or water regulator 66. Such flow control valve allows the user to bleed off some fluid flow back into the tank to vary the flow of fluid being forced out by the pump toward the processor 16.

As shown in FIG. 1, a main water supply hose 70 is provided with a free end in the form of a conventional coupler (not shown) for attaching to a faucet or other water main outlet. The hose can be used for the initial tank fill or may be used as a resupply line as the fluid level decreases over time. The main water supply hose includes a first section terminating in a y-connector 72 or flow divider to divide the flow from the main water source between a primary fill pipe 74 and an alternative secondary fill pipe 76. The primary fill pipe 74 includes a shutoff valve 78 for enabling and variably controlling flow through the primary fill pipe into the tank 12 from the water main if it is being used. Such shutoff valves may be any conventional valve used in plumbing fixtures such as a ball valve or other suitable flow control valve.

The primary pipe 74 is connected at its distal end to the hose connector located in the primary fill nipple at site 42. The interior of the primary hose nipple connects to a length of ½ inch clear vinyl tubing which extends downwardly into the tank to dispose its outlet near the bottom of the tank. If the water main is operational, fluid may be added directly through the inlet orifice of the primary fill site into the tank once the main water supply hose is connected to the water main at one end, connected to the primary fill site at the other end, and the primary shutoff valve 78 is opened.

Alternatively, if more fluid control is desired, the secondary pipe 76 may be selected. The secondary pipe is connected at is distal end to the hose connector projecting out ofthe secondary fill site 44. A water solenoid 85 is connected in series with the secondary pipe between the y-connector and secondary fill site 44. A metering control box 82 mounted on a bracket to the exterior of the tank controls the opening and closing of the water solenoid and generally includes a timer, the construction and operation of which being well known in the art, to control the time and amount of fluid being added to the recycling system. Such secondary flow arrangement allows for incremental additions to the tank 12 to keep a relatively constant water level which may be reduced due to evaporation and other environmental losses. The addition of cooler fluid from the fresh fluid supply also assists in controlling the temperature of the tank fluid which may be warmed by fluid returning from the processor. The power cord 83 to the metering box may be plugged into any conventional outlet or powered by a generator. The timing of additional introduction of water flow may still be controlled by the metering control box which may also provide a readout indicating the flow rate and amount. It is also preferable to provide a flow restrictor 75 rated at 0.12 gallons per minute and mounted on the interior of the tank in fluid communication with the secondary fill pipe 76 via the fill nipple at the secondary fill site 44. The opposite end of the flow restrictor is connected to a piece of ½ inch clear vinyl tubing extending into the tank to position its outlet near the bottom of the tank.

Referring to FIG. 1, the X-ray processor 16 generally includes a processing tray wherein different chemicals are introduced to an image on X-ray film and then rinsed with wash water to remove the chemicals from the film, fix the image, and prevent further chemical reactions which degrades the film. Wash water 14 is introduced into the tray or chamber through a wash water inlet port 18. Once the chemicals are rinsed off the film, the wash water is generally allowed to flow out a drainage port 20. The respective ports 18 and 20 may merely be an orifice or may be outfitted with a similar hose connector incorporated into the tank structure. To establish the recirculation system between the tank and the processor, the first conduit or outlet connector 28 is connected at one end to the hose connector 38 of the tank outlet orifice 26 within the processor supply site 46. The opposite end is connected to the wash water inlet port 18 of the processor. A second conduit or drainage connector 30 is connected between the drainage port 20 of the processor to one of the hose connectors 38 in one of the tank flow return sites 40. This assembly completes the recirculation loop that provides a continuous supply of wash water to the processor for use in developing images.

The tubing used in the recirculating system 10 is typically clear vinyl tubing selected for its flexibility and strength and lends itself to the overall portability of the recirculation unit. If more permanent installation is desired, a more rigid coupling or copper piping may alternatively be used. Conventional hose couplings may be used wherever the tubing mates with the tank or the processor. Hose clamps may be used for a tighter fit between the tubes or conduits and the hose connectors 38. Couplings may be constructed of plastic, metal, or any other suitable material. Filters may be incorporated at various points in the recirculation system to remove contaminants from the water supply.

Optionally, the tank may incorporate a removable lid or cover 84 and containment tray 86. The cover rests on the top edge of the tank 12 preventing contaminants from entering the fluid and reducing the rate of fluid evaporation. The containment tray 86 is disposed beneath the tank and is generally larger in horizontal cross section than the tank and includes upwardly extending guards 88 on all four sides for containing any overspill from the tank. An overspill drain hose 90 projects through a hole in one of the respective guards and generally includes a plug in the outward end. Removal of the plug enables overspill to be drained out of the containment tray.

The recirculating unit 10 may be supplied as a kit for attachment to an existing processor 16. The ease of assembly and minimal space required to set up the tank 12 and associated hardware provide significant advantages to the utility of this unit. It is also a simple matter to use a generator if no convenient electrical outlets are available. Due to the ease of assembly, it will further be appreciated that the above-described recirculation kit could be applied to other processors and devices which require a substantially continuous supply of fluid and is not limited in practice solely to film processors. It will appreciated that multiple processors may be supplied with the above-described system and that additional ports and tubing may be incorporated to facilitate such activity. Alternatively, a number of processors may be hooked up in series to form a single loop in conjunction with a single recirculating unit.

In operation, the recirculating unit 10 is first connected to an existing processor 16. This is accomplished by setting the tank 12 near the film processor within the guards 88 of the containment tray 86. The first conduit 28 is connected to the hose connector 38 projecting from the outlet orifice 26 of the processor supply site 46 of the tank and also to the wash water inlet port 18 ofthe film processor. A hose clamp may be used for a more secure fit. The second or return conduit 30 is connected between the drainage port 20 of the processor and the hose connector in return orifice 32 of one of the tank return sites 40. The pump 22 is placed within the tank and if desired secured thereto. The supply tube 62 is coupled to the pump 22 and the outlet 26. The electrical cords of the pump, metering control box 82, and processor may be plugged into an electrical outlet 56 or generator. It is preferable, however, that the pump 22 and processor 16 are connected to a central controller such as the metering control box by hardwiring or plugging the pump 22 and x-ray processor 16 into the metering control box such that all three components are centrally operated and ensure that all electrical components will turn on and off in conjunction with the operation of the processor. This arrangement allows for all three devices to be energized by a single switch to ensure all subsystems are operating simultaneously and reduce the number of steps to energize the entire system. Care should be taken to ensure the drain plug or valve 54 is closed. If available, the main water supply hose 70 is hooked up to the main water source. Assuming for this example that the operator determines not to use the metering control box, the flow valve 78 is opened to allow water from the primary fill pipe 74 to flow into the tank until the desired fill level is reached and then shutoff. If a water main is unavailable or the water quality is poor, water from an alternate source such as bottled water or rain water may be poured directly into the tank to the desired level above the intake 60 of the pump.

The power source is then activated to energize the pump 22, metering control box 82, and processor 16. The pump draws water 14 from the tank 12 through its intake 60 and forces it through the supply tube 62 and the first conduit 28 toward the processor and eventually into the processing tray or chamber. Water from the tray eventually exits through the drainage port 20 and returns under force of gravity or pressure feed through the return conduit 30 to be dumped into the tank. For refinements in water flow to the processor, the flow control valve 66 can be adjusted to bleed off some flow from the supply line and redirect it back to the tank. Further adjustments of the water flow would be within the skill level of one of ordinary skill in the art. The check valve 64 in the supply line prevents fluid flow from returning back to the pump.

If a main water source is available and metering option is desired, the operator may program the timer in the metering control box 82 to control the incremental addition of fluid into the tank 12 to keep the fluid level substantially constant or within a desired range. The primary line valve 78 is shut off so that flow will proceed through the secondary line 76. At programmed times, the water solenoid 85 will open allowing for additional amounts of water to enter the tank 12 through the primary fill pipe 74 and flow restrictor 75 to keep the fluid level near the desired level and assist in controlling the fluid temperature within the tank. If an overflow condition exists, the water will exit the either of the overflow sites 48 or 49 to be directed downwardly into the spill containment tray 86 providing an indication that the fluid flow needs to be adjusted. Should it be desired to drain the tank 12, the operator merely opens the cleanout valve 54 or removes the plug from the cleanout hose to relieve the water stored in the tank. Such a draining procedure is desirable at least once a week followed by a subsequent refill of fresh water.

The recirculation system may be used with a processor for as long as water is available in the tank for the pump to draw it in. Evaporation will eventually decrease the water level and will eventually need to be replaced. The accompanying lid 84 reduces the effects of evaporation on the system. The lid may merely rest on the top of the tank or be coupled to the tank in a suitable manner to prevent misplacement of the part. Changing the water daily and adding an algae inhibitor should keep the recirculating unit operating at peak performance. Although current testing has shown longer periods between changing water still provides satisfactory results.

While several forms of the present invention have been illustrated and described, it will also be apparent that various modifications may be made in the actual implementation of the concepts described herein without departing from the spirit and scope of the invention as defined by the following claims.

What is claimed is:

1. Recirculating X-ray film processing apparatus comprising:

a tank for holding a processing fluid and having an outlet and at least one return orifice;

a pump in fluid communication with said outlet and including an intake to be submerged in said fluid;

a motor for driving said pump;

a film processor including a processing tray with a wash water inlet port and a drainage port;

an outlet connector for connecting said outlet with said wash water inlet port to provide fluid communication therebetween;

a drainage conduit for connecting said drainage port to said return orifice to provide fluid communication therebetween, wherein said tank may be filled with a predetermined amount of fluid and said motor activated to drive said pump to, circulate said fluid out said inlet orifice to said processor and back through said inlet.

2. Recirculating apparatus as set forth in claim 1 further including:

a water regulator connected in fluid communication with said pump and said outlet to control the flow of said fluid.

3. Recirculating apparatus as set forth in claim 1 wherein:

said fluid is water.

4. Recirculating apparatus as set forth in claim 1 further including:

a supply tube connecting said pump with said outlet; and a check valve disposed within said supply tube to prevent water from returning to said pump through said supply tube.

5. Recirculating apparatus as set forth in claim 1 wherein:

said tank has a 15 gallon capacity.

6. Recirculating apparatus as set forth in claim 1 wherein:

said tank is constructed of high density polyethylene.

7. Recirculating apparatus as set forth in claim 1 wherein:

said tank is rectangularly shaped.

8. Recirculating apparatus as set forth in claim 1 further including;

a cleanout valve located near the bottom of the tank for releasing said fluid stored therein.

9. Recirculating apparatus as set forth in claim 1 wherein:

said tank is an open air container.

10. Recirculating apparatus as set forth in claim 1 wherein:

said tank further includes at least one inlet orifice constructed to be in fluid communication with a main water source for supplying said tank with said fluid.

11. Recirculating apparatus as set forth in claim 10 wherein:

a resupply conduit is disposed between said inlet orifice and said main water source.

12. Recirculating apparatus as set forth in claim 11:

wherein said resupply conduit includes first and second branches, said first branch including a flow control valve and said second branch including a fluid metering control box and solenoid for incrementally delivering the flow of fluid passing therethrough.

13. Recirculating apparatus as set forth in claim 1 wherein:

said return orifice is constructed to return fluid directly into said tank.

14. Recirculating apparatus as set forth in claim 1 further including:

a cover for said tank.

15. Recirculating apparatus as set forth in claim 1 wherein:

said pump is constructed to displace fluid.

16. Recirculation apparatus as set forth in claim 1 wherein:

said outlet and said return orifice are disposed above the highest level of said fluid.

17. A recycling kit for attachment to a film processor having a processing tray including a supply port and a drainage port, said kit comprising:

a container constructed to hold at least 12 gallons of fluid and having at least one filling port, at least one outflow port, and at least one return port;

a pump constructed to be placed in fluid communication with said outflow port and including an intake for submersion in said fluid when said container is supplied with fluid;

a connector for electrically connecting said pump with a power source;

a first elongated conduit constructed to be connected between said outflow port and said supply port for supplying said processing tray with fluid;

a second elongated conduit constructed to be connected between said drainage port and said inflow port for returning said fluid to said tank; and whereby said respective first and second conduits may be connected between said outflow port and said supply port and between said drainage port and said return port, fluid added to said tank through said filling port, and said pump actuated to continuously circulate fluid between said container and said tray.

18. A method for using a dedicated water supply with an X-ray processor comprising the steps of:

providing a fluid supply tank having at least one outflow opening and at least one return opening;

providing a pump disposed in fluid communication with said outflow opening and having an open ended intake tube for drawing fluid into said pump and forcing fluid out said outflow opening;

providing a X-ray processor having a processing tray with an inlet port and a drainage port;

connecting a first tubing between said outflow opening and said inlet port to provide fluid communication between said outflow opening and said port;

connecting a second tubing between said drainage port and said return opening to provide fluid communication between said drainage port and said return opening;

filling said tank with fluid to a predetermined level above said open end of said intake tube; and activating said pump to circulate said fluid.

19. A fluid recirculation tank apparatus for connection with an X-ray processor having a processor inlet and outlet and comprising:

an upright tank for receiving a quantity of processing fluid from a water supply and including a tank outlet for connection with said inlet and a return for connection with said processor outlet;

a pump motor on said tank and having a pump inlet to be submerged in said fluid and a discharge connected with said tank outlet; and a tank fill tube for connection with said water supply, whereby said tank outlet may be connected with said processor outlet and said discharge connected with said processor inlet so water in said tank may be circulated through said pump to said processor.

* * * * *

UNITED STATES PATENT AND TRADEMARK OFFICE

CERTIFICATE OF CORRECTION

PATENT NO. : 6,231,247 B1
DATED : May 15, 2001
INVENTOR(S) : Kenneth S. Wrye and David W. Crowe It is certified that error appears in the above-identified patent and that said Letters Patent is hereby corrected as shown below:

Title page,
Item [54], replace "RECIRCULATING-X-RAY" with
-- RECIRCULATING X-RAY --.

Column 2,
Line 1, replace "systems" with -- systems --.

Column 7,
Line 25, replace "will exit the either" with -- will exit either --.

This certificate supercedes Certificate of Correction issued March 12, 2002

Signed and Sealed this

Sixth Day of August, 2002

*Attest:*

*Attesting Officer*

JAMES E. ROGAN
*Director of the United States Patent and Trademark Office*